US009635881B2

(12) United States Patent
Sjögren et al.

(10) Patent No.: US 9,635,881 B2
(45) Date of Patent: May 2, 2017

(54) SMOKELESS TOBACCO COMPOSITION COMPRISING NON-TOBACCO FIBERS AND A METHOD FOR ITS MANUFACTURE

(71) Applicant: SWEDISH MATCH NORTH EUROPE AB, Stockholm (SE)

(72) Inventors: Martin Sjögren, Västra Frölunda (SE); Thord Hassler, Helsingborg (SE); Jörgen Lundin, Upplands-Väsby (SE); Bengt Börjesson, Nol (SE)

(73) Assignee: Swedish Match North Europe AB, Stockholm (SE)

( * ) Notice: Subject to any disclaimer, the term of this patent is extended or adjusted under 35 U.S.C. 154(b) by 160 days.

(21) Appl. No.: 14/384,147

(22) PCT Filed: Mar. 15, 2013

(86) PCT No.: PCT/EP2013/055417

§ 371 (c)(1),
(2) Date: Sep. 9, 2014

(87) PCT Pub. No.: WO2013/152918

PCT Pub. Date: Oct. 17, 2013

(65) Prior Publication Data

US 2015/0075543 A1 Mar. 19, 2015

Related U.S. Application Data

(60) Provisional application No. 61/622,121, filed on Apr. 10, 2012.

(30) Foreign Application Priority Data

Apr. 10, 2012 (EP) ..... 12163576

(51) Int. Cl.
*A24B 13/00* (2006.01)
*A24B 15/30* (2006.01)
*A24B 15/18* (2006.01)

(52) U.S. Cl.
CPC ..... *A24B 13/00* (2013.01); *A24B 15/18* (2013.01); *A24B 15/303* (2013.01)

(58) Field of Classification Search
USPC ..... 131/300, 347, 290, 352
See application file for complete search history.

(56) References Cited

U.S. PATENT DOCUMENTS 3,067,068 A 12/1962 Finberg
3,112,754 A 12/1963 Diaz et al.
(Continued)

FOREIGN PATENT DOCUMENTS

CN 1382400 12/2002
CN 1820664 8/2006
(Continued)

OTHER PUBLICATIONS

Carvalho, et al., *A comparative study for two automated techniques for measuring fiber length*, Tappi Journal, vol. 80, No. 2, Feb. 1997, pp. 137-142 XP002682636 Atlanta, US ISSN: 0734-1415.
(Continued)

*Primary Examiner* — Dennis Cordray
(74) *Attorney, Agent, or Firm* — Knobbe Martens Olson & Bear LLP

(57) ABSTRACT

A smokeless tobacco composition comprising at least one type of non-tobacco fibers, wherein the non-tobacco fibers have an average length-to-width ratio equal to or greater than 3.5:1 and equal to or lower than 100:1, and a method for manufacturing the smokeless tobacco composition.

23 Claims, 5 Drawing Sheets

(56) References Cited

U.S. PATENT DOCUMENTS

Figure 1:
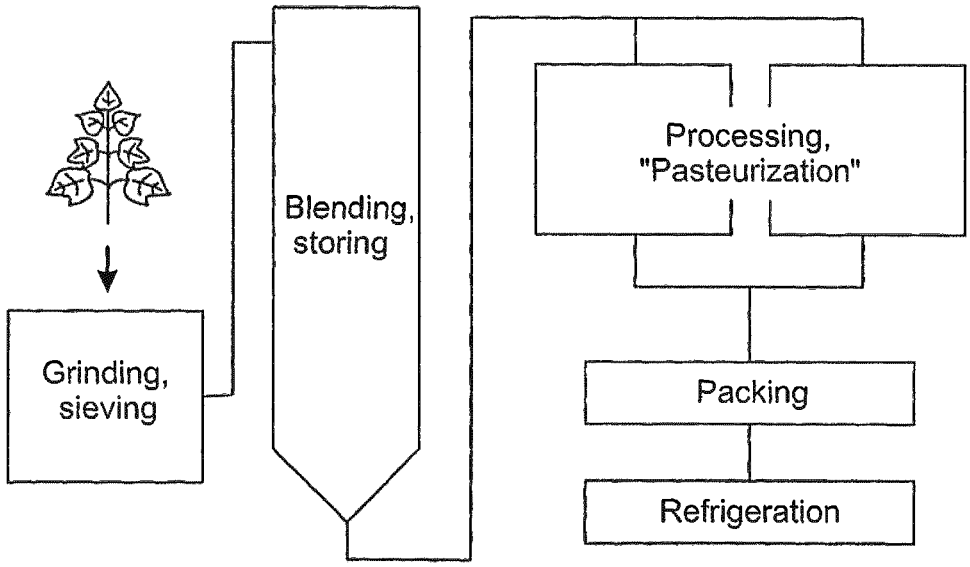

| | | | |
|---|---|---|---|
| 3,369,551 | A | 2/1968 | Carroll |
| 3,429,316 | A | 2/1969 | Hess |
| 3,516,416 | A | 6/1970 | Briskin et al. |
| 3,934,594 | A | 1/1976 | Beringer et al. |
| 4,098,421 | A | 7/1978 | Foster |
| 4,119,104 | A | 10/1978 | Roth |
| 4,133,317 | A | 1/1979 | Briskin |
| 4,164,948 | A | 8/1979 | Beringer et al. |
| 4,306,578 | A | 12/1981 | Schmidt et al. |
| 4,338,350 | A | 7/1982 | Chen et al. |
| 4,660,577 | A | 4/1987 | Sensabaugh et al. |
| 4,696,315 | A | 9/1987 | Summers |
| 4,811,746 | A | 3/1989 | Davis |
| 4,817,640 | A | 4/1989 | Summers |
| 4,987,907 | A | 1/1991 | Townend |
| 5,060,676 | A | 10/1991 | Hearn et al. |
| 5,167,244 | A | 12/1992 | Kjerstad |
| 5,372,149 | A | 12/1994 | Roth et al. |
| 5,417,229 | A | 5/1995 | Summers et al. |
| 5,690,725 | A | 11/1997 | Tucker |
| 2002/0170567 | A1 | 11/2002 | Rizzotto et al. |
| 2004/0118422 | A1 | 6/2004 | Lundin et al. |
| 2004/0123873 | A1 | 7/2004 | Calandro et al. |
| 2005/0061339 | A1 | 3/2005 | Hansson et al. |
| 2005/0100640 | A1 | 5/2005 | Pearce |
| 2005/0115580 | A1 | 6/2005 | Quinter et al. |
| 2005/0145261 | A1 | 7/2005 | Calandro et al. |
| 2005/0244521 | A1 | 11/2005 | Strickland et al. |
| 2007/0000506 | A1 | 1/2007 | Streck |
| 2007/0186942 | A1 | 8/2007 | Strickland et al. |
| 2007/0292577 | A1 | 12/2007 | Kopp et al. |
| 2010/0187143 | A1 | 7/2010 | Essen et al. |
| 2010/0300464 | A1 | 12/2010 | Gee et al. |
| 2011/0083688 | A1 | 4/2011 | Mishra et al. |
| 2011/0247640 | A1 | 10/2011 | Beeson et al. |
| 2012/0031415 | A1 | 2/2012 | Essen et al. |

FOREIGN PATENT DOCUMENTS

| | | |
|---|---|---|
| EP | 0138649 | 4/1985 |
| EP | 1667541 | 4/2007 |
| EP | 2012601 | 5/2012 |
| EP | 2649888 | 10/2013 |
| GB | 981137 | 1/1965 |
| GB | 2028095 | 3/1980 |
| GB | 2 495 893 | 4/2013 |
| IN | 0684/MUM/2005 | 7/2007 |
| JP | H 03061471 | 3/1991 |
| WO | WO 98/51169 | 11/1998 |
| WO | WO 03/053175 | 7/2003 |
| WO | WO 2004/021809 | 3/2004 |
| WO | WO 2004/056218 | 7/2004 |
| WO | WO 2005/041699 | 5/2005 |
| WO | WO 2007/035486 | 3/2007 |
| WO | WO 2008/153565 | 12/2008 |
| WO | WO 2011/042168 A1 | 4/2011 |
| WO | WO 2011/127182 A1 | 10/2011 |
| WO | WO 2012/019025 | 2/2012 |
| WO | WO 2013/158957 | 10/2013 |

OTHER PUBLICATIONS

Yang, et al., *Geographic variation and provenance selection for bamboo wood properties in Bambusa chungii*, J of Forestry Res (Harbin), vol. 20, No. 3, Sep. 2009, pp. 261-267, XP002700172, p. 263; table 3.

Jul. 24, 2013 International Search Report for related Int'l App. No. PCT/EP2013/055417.

International Search Report for PCT Application No. PCT/EP2014/056866 dated Jan. 29, 2015.

"Learn About Dietary Fiber," http://nutritiion.about.com/od/basicnutritionecourse/a/carbos/two.htm, Printed from the Internet on Mar. 25, 2015.

"Benefits of Papaya Leaf," http://jaysactivity.blogspot.com/2012/09/benefits-of-papaya-leaf.html, Printed from the Internet on Mar. 25, 2015.

Apr. 9, 2015 Office Action in related U.S. Appl. No. 13/239,952, filed Sep. 22, 2011.

Aug. 14, 2007 Int'l Search Report from related PCT App No. PCT/SE2007/000405.

Jul. 9, 2008 Int'l Search Report from related PCT App No. PCT/SE2007/050792.

Feb. 2, 2010 European Search Report from related European App No. EP 07748070.

Mar. 14, 2013 Notice of Opposition from related European App No. EP 07748070.

Aug. 5, 2013 European Search Report from related European App No. 2150137.

Sep. 22, 2014 Office Action in related U.S. Appl. No. 13/239,952.

Jan. 2, 2015 PTAAB Decision in Appeal No. 2013-002619 from related U.S. Appl. No. 12/597,655.

Bryzgalov et al., *Comparative Life Cycle Assessment of General Loose and Portion Snus*, 1N1 Life Cycle Assessment, Group 9 (May 26, 2005).

Feurst et al., Snus Kungen, 24-25 (1999) (with English translation).

Gothia Tek Standard, "Permissible amounts of non-desirable substances in Gothia Tek Svenskt Snus" (22 pgs).

Making your own snus (5 pgs).

Real Taste, "The nicotine and tobacco free alternative" http://www.realtaste.se/ (Sep. 17, 2008).

Rutqvist et al., Swedish snus and the GothiaTek standard, Harm Reduction J, 8:11 (2011).

"The Secret Revealed, or the art of preparing all sorts of snuff and smoking tobacco in the Dutch way, to the benefit of manufacturers and all snuff and tobacco lovers / as quoted by a Dutch emigrant" (2 pgs).

Wikipedia "Herb" http://en.wikipedia.org/w/index.php?title=Herb&oldid=50317112 (Feb. 25, 2013).

Wikipedia "Honey" http://en.wikipedia.org/wiki/Honey (15 pgs), (2008).

Wikipedia "Snus" http://sv.wikipedia.org/wiki/Snus (Sep. 12, 2008).

Wikipedia "Tobacco" http://sv.wikipedia.org/wiki/Tobak (Sep. 12, 2008).

Product Sheets of SOFABRAN 184-400 and SOFABRAN 184-80.

U.S. Appl. No. 12/298,799, filed Nov. 5, 2008, including prosecution history.

U.S. Appl. No. 12/892,436, filed Sep. 28, 2010, including prosecution history.

U.S. Appl. No. 14/726,272, filed May 29, 2015, including prosecution history.

U.S. Appl. No. 13/239,952, filed Sep. 22, 2011, including prosecution history.

Krylyuk et al. "Effect of particle shape on the random packing density of amorphous solids," Phys. Status Solidi (2011), No. 10, p. 2299-2302.

Meng et al. "Bending and elongation effects on the random packing of curved spherocylinders," Physical Review (2012), E 86, 061309.

Carvalho et al., Tappi Journal, 80(2), 1996, 137-142.

Jan. 23, 2017 Notice of Opposition from related European Application No. 2836088 B1.

Jan. 26, 2017 Notice of Opposition from related European Application No. 2836088 B1.

Data sheet Vitacel oat fiber HF 401, cited in Jan. 23, 2017 Notice of Opposition from related European Application No. 2836088 B1.

Data sheet Fibrex, including Fibrex 610, cited in Jan. 23, 2017 Notice of Opposition from related European Application No. 2836088 B1.

Data sheet Vitacel bamboo fiber BAF 200, cited in Jan. 23, 2017 Notice of Opposition from related European Application No. 2836088 B1.

Data sheet Vitacel bamboo fiber BAF 400, cited in Jan. 23, 2017 Notice of Opposition from related European Application No. 2836088 B1.

Data sheet JustFiber bamboo fiber, including BF C40, cited in Jan. 23, 2017 Notice of Opposition from related European Application No. 2836088 B1.

SMOKELESS TOBACCO COMPOSITION COMPRISING NON-TOBACCO FIBERS AND A METHOD FOR ITS MANUFACTURE

CROSS REFERENCE TO RELATED APPLICATIONS

This application is a U.S. National Phase Application of PCT International Application Number PCT/EP2013/055417, filed on Mar. 15, 2013, designating the United States of America and published in the English language, which is an International Application of and claims the benefit of priority to European Patent Application No. 12163576.7, filed on Apr. 10, 2012, and U.S. Provisional Application No. 61/622,121, filed on Apr. 10, 2012. The disclosures of the above-referenced applications are hereby expressly incorporated by reference in their entireties.

The present invention relates to a smokeless tobacco composition for oral use comprising at least one type of non-tobacco fibers having an average length-to-width ratio equal to or greater than 3.5:1 and equal to or lower than 100:1, and a method of manufacturing the smokeless tobacco composition.

BACKGROUND

There are many various forms of smokeless tobacco for oral use. Such forms include chewing tobacco and snuff. Snuff is available in two forms, as dry snuff for oral or nasal use and moist (or wet) snuff. There are two types of moist snuff, the American and the Scandinavian type. American-type moist snuff is available in a loose form or as pre-packed pouches and is typically used between the lower gum and lip. The use of American-type moist snuff is commonly called dipping. Snus is the Scandinavian-type of moist snuff which is also available in loose form or as pre-packed portions in pouches. Snus is typically used between the upper gum and lip.

There are a number of properties of the smokeless tobacco products for oral use that are very important for the end user. Among them, the organoleptic properties, such as texture, aroma, taste, form and package of the product are of high importance for the consumer.

Furthermore, it is required that the content of undesired substances, such as potentially carcinogenic substances, and bacteria level in the end products are as low as possible.

Thus, depending on the desired characteristics and the end use of the smokeless tobacco products, there is still a need for smokeless tobacco products for oral use that possess desired properties and can be efficiently produced.

SUMMARY OF THE INVENTION

The present invention provides a smokeless tobacco composition for oral use and a method of manufacturing the smokeless tobacco composition.

The smokeless tobacco composition and the method of its manufacturing according to the present invention are defined in the appended claims.

In a first aspect of the invention a smokeless tobacco composition comprising at least one type of non-tobacco fibers having an average length-to-width ratio equal to or greater than 3.5:1 and equal to or lower than 100:1 is provided.

In a second aspect of the invention a method for manufacturing of a smokeless tobacco composition according to the first aspect of the invention is provided, the method comprising:

a) providing a tobacco material;

b) processing the tobacco material provided in step a) and optionally other ingredients; and c) optionally packing the smokeless tobacco composition, either in pouches, or as is, in cans or boxes;

wherein non-tobacco fibers are added at one or more of the following steps:

i) prior to step b), ii) during step b), and iii) after step b), and whereby the non-tobacco fibers are mixed with the tobacco material and optionally other ingredients into a uniform blend.

SHORT DESCRIPTION OF THE FIGURES

FIG. 1. The principle of the manufacturing process according to GothiaTek® standard, as used for the manufacturing of Scandinavian type moist snuff (snus).

Figure 2:
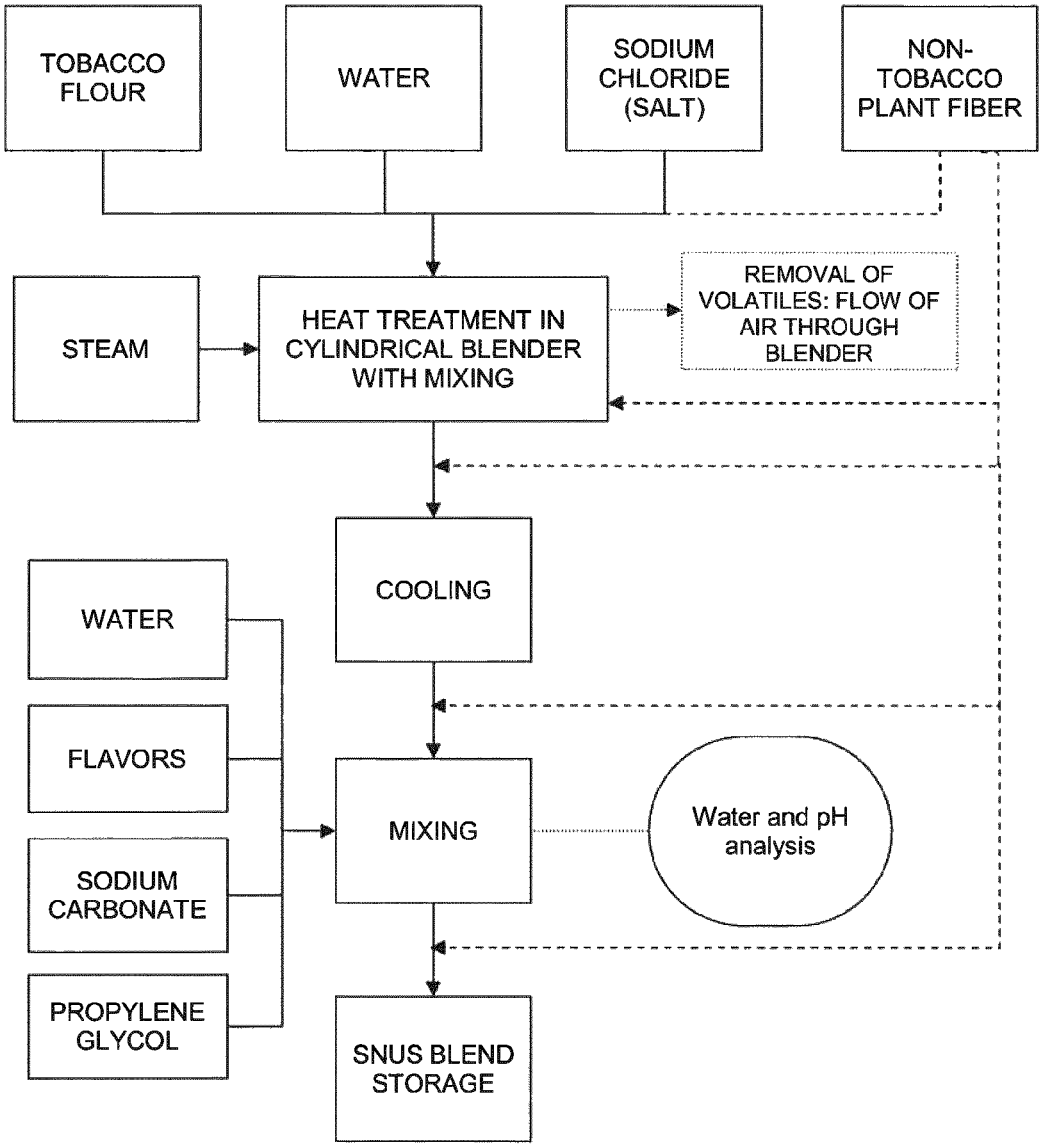

FIG. 2. Principle of the manufacturing process according to the present invention.

Figure 3:
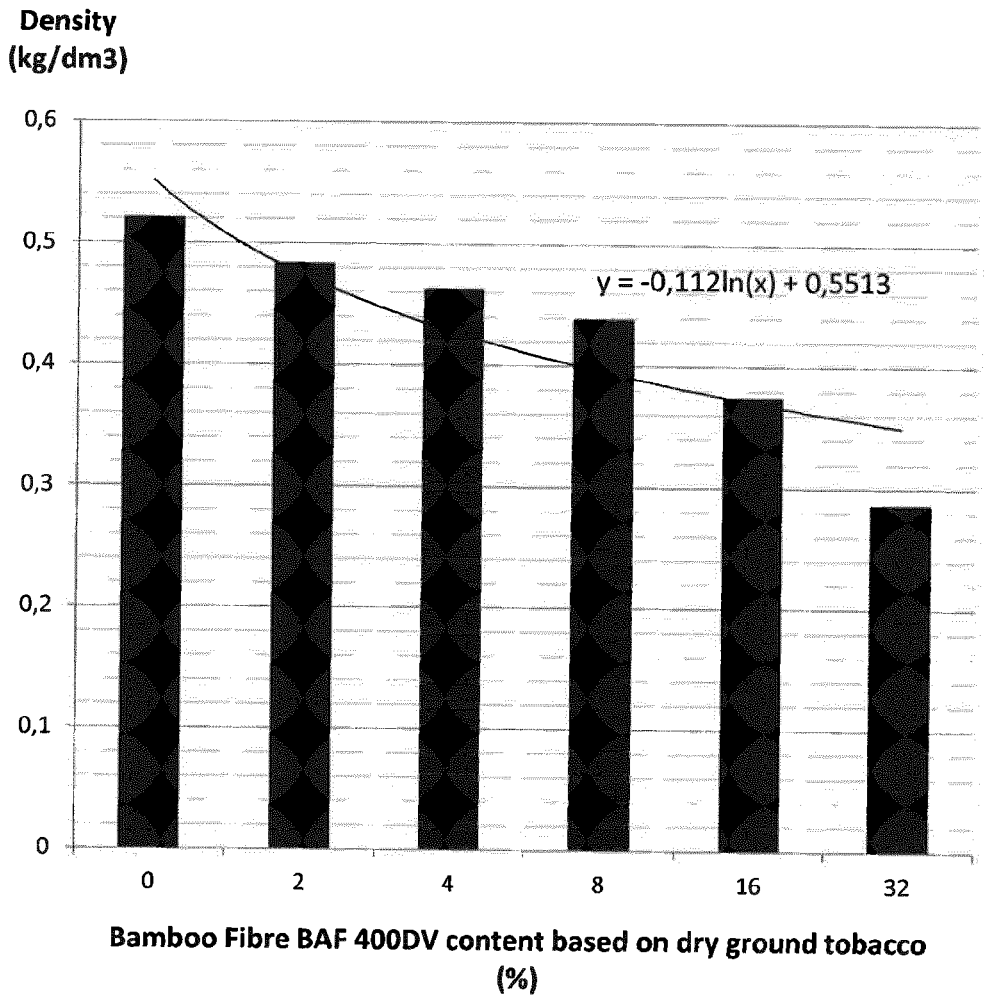

FIG. 3. Graph showing the density of a smokeless tobacco composition as a function of content of Bamboo fiber BAF 400DV.

Figure 4:
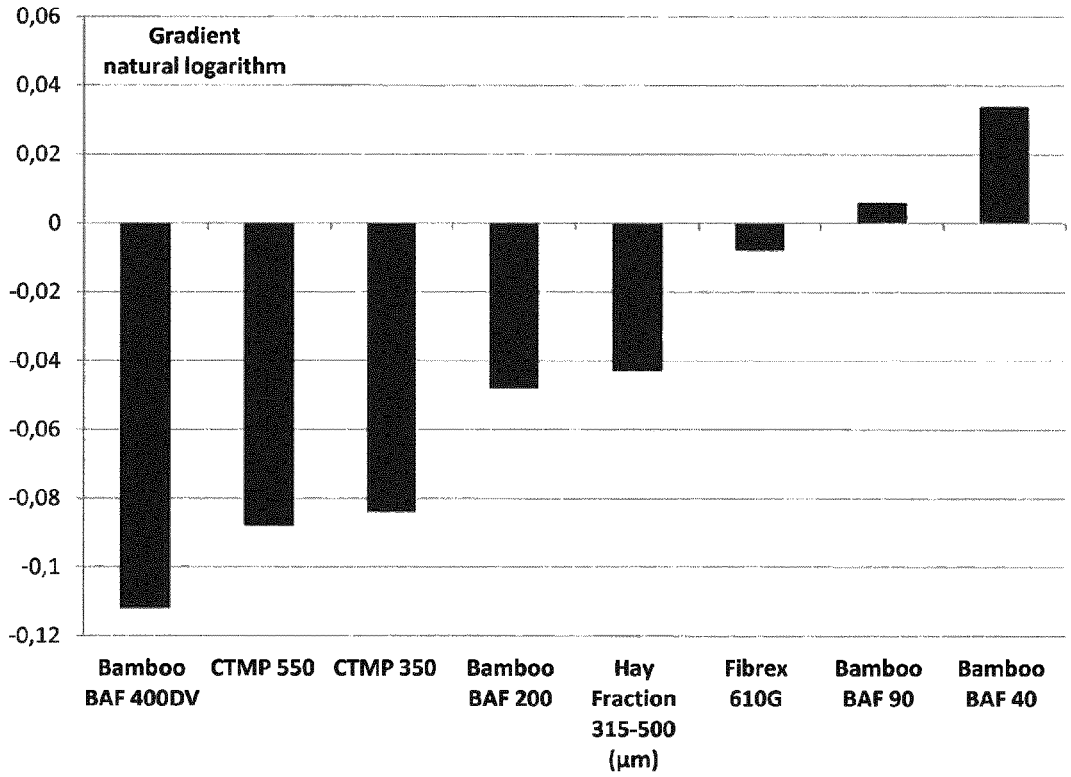

FIG. 4. Chart showing the gradient of the curve for densities versus content of different non-tobacco fiber types in a snus composition.

Figure 5:
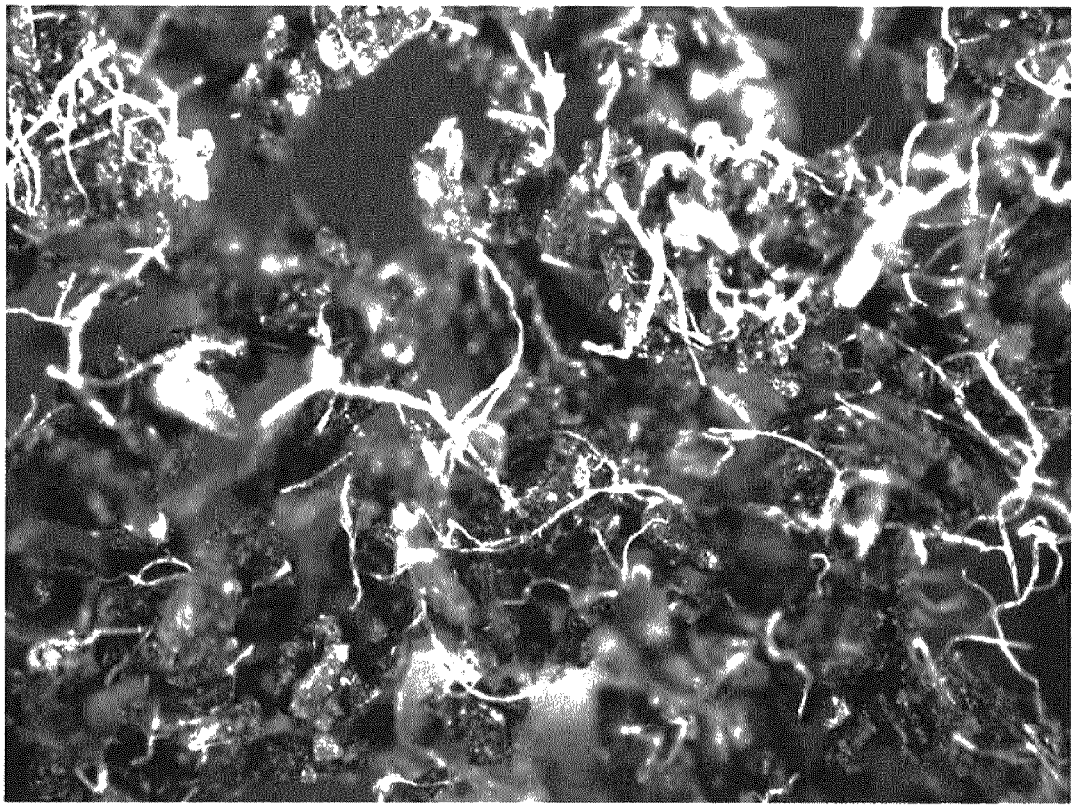

FIG. 5 is a microphotograph of a product showing non-tobacco fiber mixed with Scandinavian type moist snuff (snus)

DETAILED DESCRIPTION OF THE INVENTION

By "tobacco" is meant any part, e.g., leaves and stems, of any member of the genus *Nicotiana*. The tobacco may be whole, shredded, threshed, cut, ground, cured, aged, fermented, or otherwise, e.g., granulated or encapsulated. Tobacco may also be in the form of finished products, including any smokeless tobacco compositions that are orally consumed. Such smokeless tobacco compositions include snuff, moist snuff, such as snus, or dry snuff and chewing tobacco.

"Oral" and "oral use" is in all contexts used herein as a description for use in the oral cavity, i.e. chewing purposes, or buccally placement.

"Snus", which is the Swedish term for oral snuff, is used herein as a description for an oral tobacco product produced in a heat-treatment process instead of by fermentation. The tobacco product may be provided in particulate form, as a loose powder, or portion packed in a pouch. Particulate is used herein for a particle size of the product which enables the final product to be provided in so-called loose form, from which a pinch of snus may be made in individual sizes by the person using the product. The final water content is typically higher than 40 wt %, but semi-dry products having less than 40 wt % water content are also available. Snus is typically used between the upper gum and lip.

Chewing tobacco is most often made of loose leaf tobacco. Chewing tobacco is normally used by putting a pinch of the loose leaf chewing tobacco or a bite of the plug or twist in the lower part of the mouth between the lower gum and lip. Scandinavian chewing tobacco is normally used in the same way as snus. By chewing the tobacco once in a while, flavor is released more efficiently. Chewing tobacco as referred to here is the typical kind of chewing tobacco used in North America, commonly known as "chew" or "chaw", or Scandinavian chewing tobacco.

American-type moist snuff for oral use is commonly produced through a fermentation process of moisturized ground or cut tobacco. American-type moist snuff is available in a loose form or as pre-packed pouches and is most commonly used between the lower gum and lip but could also be used as snus between the upper gum and lip. The water content is typically higher than 40 wt %.

Dry snuff for oral use have a low water content, typically less than 10 wt % and is commonly made from fire-cured fermented tobacco. The tobacco is ground into a powder and other flavor ingredients added.

The term "tobacco material" is used herein for tobacco leaves or parts of leaves, i.e. lamina and stem, wherein the leaves and parts of leaves are finely divided and the parts of leaves are blended in defined proportions.

As used herein, the expression "water content" means the total water content in a smokeless tobacco composition, i.e., a tobacco/fiber/additive/blend (including natural water contained in the materials used, as well as added pure water) as measured by using a standardized method for water analysis, such as, Karl Fischer titration or gas chromatography (GC). The water content is given herein as percent by weight (wt %).

As used herein, the expression "dry weight" means the weight of a smokeless tobacco composition, i.e. a tobacco/fiber/additive/blend excluding the weight of water and possible also other substances that may evaporate from a smokeless tobacco composition during drying, such as humectants. Accordingly, the expression "wt % based on the dry weight of the final composition" means, for example, the weight of the tobacco material, the non-tobacco fibers, an additive, or added flavors, divided by the total weight of all components included in the final composition excluding the weight of water in the final composition and possibly other substances that may evaporate from the final composition during drying of the product before analysis of its content.

The term "additive" as used herein denotes substances other than tobacco, water and non-tobacco fiber.

"Flavor" is used herein for a substance used to influence the aroma and/or taste of the smokeless tobacco product, including, but not limited to, essential oils, single flavor compounds, compounded flavorings, and extracts.

Different types of non-tobacco fibers, as used herein, denotes non-tobacco fibers of different origin as well as different variants of non-tobacco fibers of the same origin, such as fibers of the same origin that are differently processed or having different geometries, for example different average length-to-width ratio.

There are over 1500 varieties of *Nicotiana* (tobacco) with quite varying properties. Smokeless tobacco compositions are produced from tobacco leaves, which consists of lamina and stem. Nicotine levels and content of undesired substances, such as tobacco-specific nitrosamines (TSNAs) in lamina and stems depend on several factors, such as the tobacco variety, leaf position on the plant, agricultural practices, fertilizer treatment, degree of ripening, curing time and curing condition. In fact, every step in tobacco production may influence the level of nicotine and TSNAs to a certain degree. Furthermore, depending on blending recipe, type and amount of additives, and product design all types of tobacco products contain a very wide range of nicotine concentration.

Smokeless tobacco compositions with a high content of lamina tend to make the smokeless tobacco product more sticky and this type of smokeless tobacco compositions also tend to have a higher nicotine content. Excessive stickiness of smokeless tobacco compositions causes a considerable amount of the smokeless tobacco composition to build up deposits on machine surfaces used for production and packaging of the smokeless tobacco composition product, which generates wastage, such as loss of tobacco material, smokeless tobacco composition and rejection of pouches, and thus increased production costs. Further, the deposits cause variations in pouch weight and also increased break frequency in the production, resulting in not only decreased product uniformity but also reduced production efficiency. In the extreme case the stickiness and the associated build-up of deposits of smokeless tobacco composition fragments on machine surfaces may completely prevent production of the smokeless tobacco composition.

The organoleptic properties of a smokeless tobacco composition, such as texture and taste, are important for the consumer. The weight ratio between stem and lamina is one of the factors that usually affects the texture, the nicotine content and also the content of undesired substances of a smokeless tobacco composition made thereof. Extensive efforts are required in order to be able to formulate a smokeless tobacco composition using tobacco originating from different tobacco varieties and balancing the weight ratio of lamina to stem to achieve the desired texture, nicotine content and taste. There are several different limitations determining how these compositions may be formulated in order to obtain the desired characteristics. Oftentimes an experimental composition may have a desirable taste but an undesired texture. Thus, it is desirable to have a means to provide the product with the desired texture without impacting its taste or compromising the health of the consumer.

An advantage with the use of non-tobacco fibers in the smokeless tobacco composition according to the present invention is that the texture and nicotine content can be regulated while the amount of undesired substances can be reduced. This makes it possible to use almost any variety of tobacco and any part of the leaves thereof and still be able to produce the desired end product.

Thus, the present invention enables the use of tobacco varieties or weight ratios between lamina and stem that otherwise would not be preferred for use in the production of smokeless tobacco compositions.

An advantage with the smokeless tobacco composition according to the present invention is that the amount of the composition that deposits on the process equipment is significantly reduced, while the organoleptic properties are preserved.

A further advantage of the smokeless tobacco composition according to the present invention is that it is convenient to pack in pouches and thereby the rejection of pouches not fulfilling the product requirements and thus the packaging waste is significantly reduced during production compared to smokeless tobacco compositions without non-tobacco fibers of the present invention.

By reducing the deposits on the processing equipment and the packaging waste, higher overall equipment effectiveness (OEE) is provided and thereby significant reduction of production cost is obtained.

Another property relevant for the use of the smokeless tobacco product is the rate of extraction of flavor and nicotine. It is generally advantageous to have a high rate to provide a fast satisfaction, reducing nicotine craving and provide an initial strong flavor experience. The rate of extraction depends on the compactness of the pouch or the pinch formed by smokeless tobacco composition in loose form, where a more open structure would provide a faster extraction rate. It is thus desirable to be able to reduce the compactness of the smokeless tobacco composition in order to increase the extraction rate of nicotine and flavor. Nicotine extraction from a smokeless tobacco product when used by a consumer is never complete. Typically a consumer removes the smokeless tobacco product after 20 minutes to an hour. There is a significant variation between consumers to what extent they extract nicotine from a smokeless tobacco product. In rare cases 50% of total nicotine content is extracted, while in other cases only 10% is extracted.

An advantage with the smokeless composition according to the present invention is that the extraction rate of nicotine may be regulated by modifying the compactness of the composition by varying the content of non-tobacco fibers in the composition. With the smokeless tobacco composition comprising non-tobacco fibers according to the present invention the rate of nicotine extraction can be increased, i.e. higher amounts of nicotine can be extracted for the same period of use, compared with a corresponding smokeless tobacco composition that comprises the same amount of tobacco material but being without the non-tobacco fibers used in the present invention.

Further, users of smokeless tobacco compositions, such as moist snuff, generally prefer a certain size of the pouch. If and when a smaller pouch is tried many consumers feel that something is missing between the gum and lip where consumers normally place their tobacco. For pre-packed pouches of smaller size it would be desirable to be able to increase the size, i.e. reduce the volume weight, also termed density, to provide the desired mouth feel for the consumer while keeping the same amount of tobacco and thereby nicotine content in the composition. For smokeless tobacco compositions in loose form, such as loose snuff, it is advantageous for the consumer to be able to form a pinch of desired size regardless of the type of tobacco material used in the composition.

Another advantage with the smokeless tobacco composition according to the present invention is that it is providing a considerable decrease in density, i.e. increased volume per unit weight, compared to corresponding smokeless tobacco compositions without non-tobacco fibers of the invention. With a smokeless tobacco composition according to the present invention the weight might be decreased up to 50% of a pouch without any volume decrease and thereby maintaining the desired size.

Incorporation of non-tobacco fibers in the smokeless tobacco composition according to the present invention also provides the product with a more spongy character that is experienced as increased softness and also enables a product that easily adapts its shape to the curvature of the space between the lip and the gum, which may be expressed by consumers as better fit.

Some consumers prefer drier products while others prefer more moist products, so there is a merit in offering a range of smokeless tobacco products with different water contents to the consumers. A particular problem for the manufacturing of products with high water content is to provide a composition wherein leaking of water is avoided. It is, thus, desirable to provide a smokeless tobacco product comprising a high content of water with an increased water holding capacity.

Smokeless tobacco products may have a water content ranging from around 10 wt % for very dry products up to around 60 wt % and even higher for products with the highest water content. The water holding capacity of the smokeless tobacco compositions affects the moist feeling of the product. A composition having a high water holding capacity can feel drier than a composition with a lower water holding capacity, although the compositions have the same water content.

It is speculated that the presence of voids in the structure of the smokeless tobacco composition is important for the water holding capacity. Although not conclusively shown, the presence of voids should be connected to the volume weight, or density.

An advantage with the smokeless tobacco composition according to the present invention comprising the non-tobacco fibers is that the water holding capacity may be increased.

In general, average fiber length can be calculated in several ways of which the most simple is the numerical average fiber length $\bar{x}_a$, also known as the arithmetical average fiber length. The numerical average fiber length is calculated with formula I, where $x_i$ is the length of the fibers in each size class, i, and n the total number of fibers.

$$\bar{x}_a = \frac{\sum_i x_i}{n} \tag{1}$$

However, a commercial fiber composition typically contains a large number of very small particles, so called fines, although these constitute only a small volume of the total fiber composition. Due to their large number, the small particles thus have a great impact on the numerical average fiber length for the fiber composition giving a smaller value compared with other ways to calculate the average fiber length. Therefore, throughout the present invention the length-weighted average fiber length defined by formula (2) is used for calculating the average fiber length of the non-tobacco fibers used in the present invention $$\bar{x}_l = \frac{\sum_i l_i x_i}{\sum_i l_i} \tag{2}$$

wherein $\bar{x}_l$ represents length-weighted average length, as defined in for example the STFI Fiber Master, STFI report TF 70, 1997, STFI, Stockholm, and where $x_i$ in this case is equal to $l_i$, i.e. the length of the fibers in each size class.

The variation in fiber width is typically much smaller than the variation in fiber length and thus the average fiber width is calculated as the numerical average fiber width.

Throughout the present invention the expression "average length-to-width ratio" of the non-tobacco fibers denotes the ratio of the length-weighted average fiber length to the numerical average fiber width.

Examples of literature describing instrumentation and methods for the measurement of fiber characteristics such as size, shape, distributions etc. are Terry Allen, Particle size measurement, 4th edition, Chapman and Hall 1991; Beddow J K, Particle characterization in technology: vol 1: applications and microanalysis, CRC, Boca Raton, 1984; Beddow J K, Particle characterization in technology: vol 2: morphological analysis, CRC, Boca Raton, 1984; James P M Syvitski, Principles, Methods and Application of Particle Size Analysis, Cambridge University Press, 2007; Henk G Merkus, Particle Size Measurements, Established Techniques and Experiments, Springer-Verlag New York Inc, 2008.

An instrument suitable for measurements on fibers is the Fiber Tester from Lorentzen & Wettre. With this instrument the material is analyzed in wet dispersion and the area and perimeter of a fiber is measured from a digital image. The fiber length is calculated as perimeter/2 and the width as area/length.

Measurements and calculations of fiber dimensions and distributions may in principle be performed with any instrument capable of image analysis and built-in evaluation software or external software like MatLab from Math Works. Examples of manufacturers of such equipment include, but are not limited to; HiRes FQA from OpTest Equipment, MorFi Compact from TECHPAP SAS and Metso FS300 from Metso Automation.

Non-tobacco fibers suitable for use in the smokeless tobacco composition of the present invention are fibers with an average length-to-width ratio equal to or greater than 3.5:1 and equal to or lower than 100:1.

An object according to the first aspect of the present invention is thus to provide a smokeless tobacco composition for oral use comprising at least one type of non-tobacco fibers having an average length-to-width ratio, i.e. the length-weighted average fiber length to the numerical average fiber width, equal to or greater than 3.5:1, preferably equal to or greater than 4:1, more preferably equal to or greater than 6:1, more preferably equal to or greater than 10:1, even more preferably equal to or greater than 15:1.

The non-tobacco fibers used in the smokeless tobacco composition according to the present invention have an average length-to-width ratio equal to or lower than 100:1, preferably equal to or lower than 60:1, more preferably equal to or lower than 25:1.

In one embodiment, the length-weighted average fiber length of suitable non-tobacco fibers according to this invention may be greater than about 50 μm, preferably greater than about 100 μm.

Increased fiber length requires increasingly high shear equipment to provide a homogeneous composition. The upper limit for the length of the non-tobacco fibers is thus typically determined by the possibility of obtaining a uniform composition. As a general rule the higher the length-weighted average fiber length the more pronounced the effect and the more difficult is becomes to obtain an acceptable level of uniform distribution of the fibers in the material. The shear used to provide the desired level of uniform distribution of the fibers should not be so high that it cuts the fibers thereby reducing their length-to-width ratio. Most natural non-tobacco fibers in accordance with the present invention require considerable energy to be ruptured, so in practical terms this is not a problem.

The non-tobacco fibers in accordance with the present invention are preferably water insoluble.

The non-tobacco fibers suitable for use according to the present invention may be natural-sourced fibers or synthetic fibers. The non-tobacco fibers may be processed before use, such as washed, ground, cut, cured, aged, fermented, chemically modified or otherwise. However, the non-tobacco fibers should be suitable for oral use and preferably comply with national food acts. Therefore, even though many of synthetic fibers may be inert and nontoxic and could be used, especially in smokeless tobacco products that are removed from the mouth after use, natural sourced fibers are preferred. In certain jurisdictions, such as Sweden and the United States, smokeless tobacco products such as snuff and snus are regulated and thus the non-tobacco fibers need to fulfill regulation requirements.

The non-tobacco fibers suitable for use according to the present invention are preferably selected from plants, wherein the fibers have an average length-to-width ratio equal to or greater than 3.5:1 and equal to or lower than 100:1, such as hay with a length fraction from about 315 to 500 μm; bamboo fibers, such as Vitacel® Bamboo Fiber of grades BAF 200 and BAF 400 DV, supplier J. Rettenmaier & Söhne GMBH+CO.KG, (JRS); and chemo-thermo-mechanical pulp (CTMP) fibers, for example from spruce or pine or a mixture of spruce and pine, such as Waggeryd BCTMP of freeness 350 and 550 that consists of 80% spruce and 20% pine. A particularly preferred source of fibers is bamboo having an average length-to-width ratio equal to or greater than 3.5:1 and equal to or lower than 25:1.

According to one embodiment of the invention the non-tobacco fibers used in the smokeless tobacco composition may be a combination of two or more different types of non-tobacco fibers.

A suitable weight ratio between the tobacco material and the non-tobacco fibers in the smokeless tobacco composition depends on, inter alia, the desired stickiness and density of the smokeless tobacco composition. The higher the stickiness of the smokeless tobacco composition the higher amount of non-tobacco fibers is needed for reducing deposits in the manufacturing equipment. The amount of the non-tobacco fibers in the smokeless tobacco composition may for practical reasons be in the range from 1 wt % up to 60 wt %, preferably from 1 to 30 wt %, and more preferably from 1-10 wt %, based on the dry weight of the final composition. Further preferably, the amount of the non-tobacco fibers in the smokeless tobacco composition is in the range from 4 wt % up to 60 wt %, more preferably from 4 to 30 wt %, and even more preferably from 4-10 wt %, based on the dry weight of the final composition.

Already with low additions of non-tobacco fibers, such as from about 1 wt % and above, based on the dry weight of the final composition, it is possible to produce a smokeless tobacco composition having improved overall properties than a corresponding composition without non-tobacco fibers. Examples of such improved properties are reduction of deposits on the process equipment and less rejection of pouches not fulfilling the product requirements. In fact, there are some smokeless tobacco compositions that would not even be able to pack without the addition of non-tobacco fibers.

At higher amounts of non-tobacco fibers, for example from 4 wt % and above, further effects are obtained. For example the texture may be regulated, which enables a less runny (non-drop) smokeless tobacco composition. Further, the extraction rate of nicotine may be regulated by modifying the compactness of the composition by varying the content of non-tobacco fibers in the composition. In addition, the density of the smokeless tobacco composition can be decreased so that the weight of a pouch can be decreased, for example up to 50%, without any volume decrease and thereby maintaining the desired size of the pouch. Also, using from 4 wt % and above of non-tobacco fibers in the smokeless tobacco composition, based on the dry weight of the final composition, enables manufacturing of smokeless tobacco compositions with different technology platforms, for example manufacturing of dry snuff that is subsequently conditioned with water.

In a preferred embodiment of the present invention the smokeless tobacco composition for oral use is moist snuff, and preferably snus.

According to another embodiment of the present invention, the smokeless tobacco composition may comprise water in an amount from approximately 10 to 60 wt % of the total weight of the final composition or more.

The smokeless tobacco composition according to the present invention may contain further ingredients in addition to tobacco, water and non-tobacco fibers, for example humectants, such as glycerol and propylene glycol; sodium chloride (NaCl); additional salt(s), such as a carbonate for example sodium carbonate, and/or ammonium chloride; a dye, such as, caramel (E150), or vegetable carbon (E153); and flavors.

The flavors may be selected from the group comprising fruits, berries, flowers, herbs, oil of fruits and edible plants or a combination thereof. In addition to natural flavor extracts, flavor may also be provided by imitation, synthetic, or artificial flavor ingredients and blends containing such ingredients. Flavors may be added as a powder, an oil, or in encapsulated form.

Another object of the present invention is a smokeless tobacco composition packaged in loose form in a container, such as a can or a box with a lid. The density of the loose form of the smokeless tobacco composition comprising at least one type of non-tobacco fibers having an average length-to-width ratio equal to or greater than 3.5:1 is lower than the density of a corresponding smokeless tobacco composition without said fibers.

A further object of the present invention is a smokeless tobacco composition packaged in pre-packed portions, such as pouches, packed in any suitable package, or in any other package known in the art.

According to a preferred embodiment of the present invention there is provided a pouch containing the smokeless tobacco composition of the invention. By varying the concentration of the non-tobacco fibers added it is possible to control the weight of the pouch so that the weight of the pouch can be varied while keeping the volume constant without changing the overall consumer experience. Thus, although the total pouch weight may decrease the volume will remain constant without affecting the desired consumer satisfaction.

Another object of the present invention is to provide a product comprising the smokeless tobacco composition according to the invention in a box or bag made out of cellulose and/or metal and/or a polymer.

Manufacturing processes of oral smokeless tobacco products, e.g. moist snuff and chewing tobacco, are well known to the person skilled in the art, and any known process thereof may be used. Moist snuff is known as either Swedish-type snus or American-type moist snuff.

A general description of snus manufacturing is presented by e.g. ESTOC, European Smokeless Tobacco Council, and the GothiaTek® quality standard for snus which is described below. Methods for the manufacture of American type moist snuff and chewing tobacco are described in e.g. 'Wahlberg, I., Ringberger, T. (1999) Smokeless Tobacco. In: Tobacco: *Production, Chemistry and Technology*, (eds D. L. Davis & M. T. Nielsen) pp. 452-460. World Agriculture Series, Blackwell Science Ltd. Tobacco is the raw material in any oral smokeless tobacco product.

The principle of snus manufacturing is to mix ground or cut tobacco with water and sodium chloride and heat treating the mixture for a period of time long enough, typically several hours, and at a temperature high enough, to meet the demands for pasteurization. The heat treatment also gives texture and color to the mixture and enhances the natural tobacco flavors. After heat treatment the mixture is chilled. Additives such as pH-regulators and flavorings are then added and the mixture may be adjusted in water content. The ready-made blend is packed, typically in cans, or boxes as loose snus or as portions, such as pouches.

American-type moist snuff is commonly produced through a fermentation process of moisturized ground or cut tobacco. Flavors and ingredients are mixed to the blend and water is added to adjust the moisture content. American-type moist snuff is available in a loose form or as pre-packed pouches.

Dry oral snuff is made of a finely ground tobacco. The product may be heat treated but is normally manufactured from fire-cured fermented tobacco which is ground into a powder to which other ingredients such as flavors are added.

Chewing tobacco is most often made of loose leaf tobacco, which is cured at a slightly elevated temperature. The tobacco leaves are then threshed into flakes and the mid-rids (stems) are removed. The tobacco fragments thus obtained are usually treated with a solution of flavors and additives, dried to lower the moisture content and packed in a consumer package. The product achieved is known as "loose-leaf chewing tobacco". The treated tobacco fragments could also be compressed to blocks of tobacco (product known as "plugs") or spun to thick strands of tobacco (product known as "twist"). For the Scandinavian type of chewing tobacco, the strands are thinner and cut into pieces The smokeless tobacco product according to the present invention is preferably manufactured according to the GothiaTek® standard.

GothiaTek® Standard

GothiaTek® standard is a well established standard which states rules and requirements for manufacturing of snus. The standard includes requirements on tobacco, additives, manufacturing process and product information.

When making snus according to GothiaTek® standard, the typical main ingredients, besides tobacco, are water, sodium chloride (NaCl) and sodium carbonate ($Na_2CO_3$). Flavors and humectants are also common ingredients and additional food approved additives might be used. Sodium chloride is added mainly for its taste enhancing properties, but it also has a preservative effect which contributes to improved shelf life of the products. Sodium chloride lowers the water activity of the products, thus preventing microorganisms from growing. Sodium carbonate is used to give the products their characteristic aroma profile, but also brings the pH to the slightly alkaline side. Flavors used are generally natural or nature identical compounds that comply with food regulations. Flavors are usually dissolved in ethanol when added. Humectants, such as glycerol and propylene glycol, are normally added. According to the standard, there are two major steps in the manufacturing process of converting tobacco to a snus composition; a) grinding (or cutting) and sieving and b) snus-processing (see FIG. 1).

a) Grinding and Sieving

Tobacco flour is produced by batch grinding. Compressed tobacco is emptied from its cases and torn to large fragments which are cut to pieces. The cut tobacco pieces are dried and transported to a mill. The tobacco is ground and ground tobacco particles are sieved and separated into fractions. Too large particles are brought back to the mill for re-grinding. The cutting, grinding and sieving is done in equipment where foreign objects such as fragments of metallic material and stones are separated and removed from the tobacco. Three approved fractions are weighed in separate fractions scales. The weighed tobacco flour fractions are collected to pre-set quantities in a silo and blended by circulation. The blended tobacco flour is stored in a silo. Different types of tobacco flours are kept in separate silos.

b) Snus-Processing

The snus mixture is produced by batch processing and should be carried out in a closed system to minimize the risk of contamination from bacteria or foreign substances. Since automatic feeding of tobacco and additives is preferred, the whole process may be computer controlled and can be run day and night, all week around. The process starts with loading of tobacco flour, water, sodium chloride (NaCl) and possibly additional additives, into a cylindrical blender. Loading is done while stirring. The loaded materials are mixed to a homogeneous blend which is heated by injection of steam. The blend is then kept heated for several hours with support of steam to ensure reduction of the natural bacterial flora in the tobacco and to bring texture, taste and color to the snus blend. Time, temperature and frequency of stirring during heat treatment, parameters specified for different snus blend qualities, are preferably controlled by a process computer program. The heat treatment is traditionally referred to as "sweating", but is to be seen as a pasteurization process.

After heat treatment, the blend is chilled by flow of cold water through the blender jacket during stirring. Water, flavors, sodium carbonate and possibly additional additives are then added to the chilled blend. The blend is finally mixed to a homogeneous snus material. The finished blend is emptied from the blender for packing, as is in cans, or as pre-packed portions.

The non-tobacco fibers used in the composition according to the present invention may be added anywhere in the manufacturing process as long as uniform distribution of the non-tobacco fibers in the final tobacco smokeless composition is achieved. All the non-tobacco fibers may be added at one stage in the process, such as either prior to the processing, during processing or after the processing of the tobacco material. Alternatively the addition of non-tobacco fibers may be made at two or more different stages in the process. For example, one portion of the non-tobacco fibers may be added to the tobacco flour, while another portion may be added further down the process, such as immediately before packing the smokeless tobacco composition in pre-packed portions. FIG. 2 shows the principle of the manufacturing process according to the present invention wherein the non-tobacco fibers are added together with tobacco flour, water and sodium chloride. As long as a uniform distribution of the non-tobacco fibers is achieved the non-tobacco fibers or a part of the total added non-tobacco fibers may be added later in the manufacturing process, as shown by the dotted line in FIG. 2.

In one embodiment of the method according to the present invention the processing of the tobacco material comprises a heat treatment, preferably a pasteurization process.

In a further embodiment of the method for manufacturing the smokeless tobacco composition according to the present invention the non-tobacco fibers are added prior to the processing of the tobacco material.

In a preferred embodiment, the non-tobacco fibers are added during the processing of the tobacco material.

In an alternative embodiment, the non-tobacco fibers are added after the processing of the tobacco material.

In one embodiment of the method of the present invention, the non-tobacco fibers are preferably added as early as possible in the manufacturing process, preferably as early as possible during the processing of the tobacco material. The incorporation of the non-tobacco fibers is easier and requires less mixing when the fiber and tobacco material have low water content. Later in the production process water, salt and other ingredients are added, which may increase the total water content of the composition and thus render mixing more difficult.

In an alternative embodiment of the present invention, the non-tobacco fibers are added and incorporated in the finished composition just prior to packing. Late addition of the non-tobacco fibers may still provide improvement in all above identified improvement areas.

In one embodiment of the present invention water, sodium chloride (NaCl) and possibly additional additives may be added to the smokeless tobacco composition at the start of the processing of the tobacco material, preferably before the heat treatment.

Water, flavors, sodium carbonate and possibly additional additives may be added to the smokeless tobacco composition prior to the processing of the tobacco material, during the processing of the tobacco material, or after the processing of the tobacco material. Preferably, water, flavors, sodium carbonate and possibly additional additives are added during the processing of the tobacco material.

The method according to the present invention, since it follows the procedure of GothiaTek® standard, implies hygienic handling of all ingredients and pasteurization of the loaded materials, thus assuring a final composition with negligible levels of bacteria.

According to a preferred embodiment of the present invention the method comprises a heat treatment, wherein the temperature may be held at about 70-100° C. during approximately 1 to 30 hours, preferably approximately 10 hours. According to yet another preferred embodiment the method comprises a cooling step, wherein the temperature of the blend is cooled down to 15-30° C., preferably approx. 20° C., during 0.5 to 2 hours of applied cooling while stirring.

According to yet another preferred embodiment the manufacturing method is kept in a closed system and handling of all ingredients complies with food safety regulations.

The invention is further illustrated by means of the following non-limiting examples. Parts and percentages relate to parts by weight and percent by weight, respectively, unless otherwise stated.

EXAMPLES

All smokeless tobacco compositions were manufactured in accordance with GothiaTek® standard.

Example 1

Impact of a smokeless tobacco composition comprising non-tobacco fibers according to the present invention on the overall equipment effectiveness (OEE) compared to that of a smokeless tobacco composition that does not comprise such fibers.

A smokeless tobacco composition, R1, was made according to GothiaTek® standard containing the following ingredients:

| Ingredients | content (wt %) |
|---|---|
| Water | 45.8 |
| Tobacco mixture (lamina and stem at a ratio of 71:29, water content 7%) | 43.5 |
| Salt | 4.7 |
| Propylene glycol | 3.0 |
| Sodium bicarbonate | 2.7 |
| Flavors | 0.3 |

The content of lamina in tobacco composition R1 is very high making it sticky and difficult to form snus pouches from.

Pouches of snus were made from a composition comprising only R1 without non-tobacco fibers respectively from a composition comprising R1 and 8% bamboo BAF400DV. The moisture content of the bamboo BAF400DV fiber is 4%. The latter composition was obtained by mixing 5 kg of R1 and the non-tobacco fibers in a ploughshare mixer (Lödige, FM130D) with a capacity of 50 kg tobacco composition. The content of non-tobacco fibers was calculated on the total weight of the final smokeless tobacco composition. The process for making the pouches is described in U.S. Pat. No. 6,135,120. The process was set to produce pouches with 0.9 g weight. The pouch making machine is equipped with a vision camera that inspects each pouch and rejects those which have improper shape or where particles of snus is seen by the camera in the weld of the pouch paper wrapping the smokeless tobacco composition.

The results are present in Table 1. Water % is the total water content including natural water contained in the materials used, as well as added pure water, and is measured by gas chromatography. Waste % is calculated by determining the number of pouches rejected in relation to the total number of pouches produced.

TABLE 1

| Composition | | average length- | | |
|---|---|---|---|---|
| R1 (wt %) | Non-tobacco fibers (wt %) | to-width* ratio of non-tobacco fibers (L/W) | Water (wt %) | Waste (%) |
| 100% | — | — | 50.4 | 100.0 |
| 92% | 8% Bamboo BAF400DV | 15.3 | 49.3 | 26.4 |

*average length- to-width ratio denotes the ratio of the length-weighted average fiber length to the average fiber width The tobacco composition R1 was not possible to pack in pouches, i.e. the waste was 100%. When adding bamboo fibers (BAF 400DV) having an average length-to width ratio (L/W) equal to or greater than 15:1, the packing waste was significantly reduced, as can be seen from Table 1.

Example 2

Smokeless tobacco compositions comprising non-tobacco fibers of different origin and with different average length-to-width ratios were prepared and their impact on the overall equipment effectiveness (OEE) was calculated.

A tobacco composition, R2, was made according to GothiaTek® standard containing the following ingredients:

| Ingredients | content (%) |
|---|---|
| Water | 45.8 |
| Tobacco mixture (lamina and stem at a ratio of 57.5:42.5, water content 7%) | 43.5 |

-continued

| Ingredients | content (%) |
|---|---|
| Salt | 4.7 |
| Propylene glycol | 3.0 |
| Sodium bicarbonate | 2.7 |
| Flavors | 0.3 |

The tobacco composition R2 is sticky and difficult to form snus pouches from.

Non-tobacco fibers from ordinary hay were prepared by grinding hay in a knife mill (SM2000, Retsch) with a 0.5 mm grid. The hay was then sieved and the fraction of 315-500 microns was used. Non-tobacco fibers of bamboo, cacao and oat were used as is from the respective provider.

The tobacco composition R2 was divided in fractions of 5 kg and mixed with different types of non-tobacco fibers, each different fiber type having different average length-to-width ratio (L/W).

The mixing was performed in a ploughshare mixer (Lödige, FM130D) as in Example 1. Pouches were made in the same equipment as used in example 1 and with the same machine settings. Table 2 illustrates the content of different non-tobacco fibers with different average length-to-width ratio (L/W), mixed with R2. The table also shows the waste figures for the different compositions comprising different non-tobacco fibers. The content of non-tobacco fibers is calculated on the total weight of the final smokeless tobacco composition.

TABLE 2

| Composition | | Average length- | | |
|---|---|---|---|---|
| R2 (wt %) | Non-tobacco fibers (wt %) | to-width* ratio of non-tobacco fiber (L/W) | Water (wt %) | Waste (wt %) |
| 100% | — | — | 50.0 | 100.0 |
| 96% | 4% cacao Moner Llacuna Ficao | 1.3 | 48.7 | 100.0 |
| 96% | 4% Oat HF 401 | 3.9 | 48.0 | 55.8 |
| 96% | 4% hay, fract. 315-500 μm | 6.5 | 48.8 | 35.4 |
| 96% | 4% Bamboo BAF400DV | 15.3 | 49.0 | 16.0 |

*average length- to-width ratio of the length-weighted average fiber length to the average fiber width Tobacco composition R2 without the addition of non-tobacco fibers of the invention was not possible to pack in pouches. When adding non-tobacco fibers having an average length-to-width ratio (L/W) equal to or greater than 3.5:1, the packing waste was significantly reduced, as can be seen from Table 2. The bamboo fibers (BAF 400DV) showed the best result.

Example 3

Non-tobacco fibers from different origin and with different average length-to-width ratios were studied by measuring density.

Fiber types used in the present example were Vitacel® Bamboo Fiber, grades BAF 40, BAF 90, BAF 200 and BAF 400 DV from J. Rettenmaier & Söhne GMBH+CO.KG, (JRS); Fibrex from Danisco Sugar AB; Waggeryd CTMP of freeness 350 and 550, and ordinary hay.

The fiber average length-to-width ratio for each of the different non-tobacco fiber types is presented in Table 3.

Ground tobacco made in accordance with the GothiaTek® standard, water and sodium chloride (NaCl) were loaded into a ploughshare mixer (Lödige, FM130D). The loaded materials was mixed to a homogeneous blend and heated by injection of steam. The blend was then kept heated between 70 and 100° C. for several hours with support of steam to ensure reduction of the natural bacterial flora in the tobacco and to bring texture, taste and color to the tobacco blend. After heat treatment the blend was chilled to about 20 degrees Celsius. The semi-finished tobacco composition with the water content of 37 wt % was unloaded and transferred to plastic bags.

Non-tobacco fibers from hay and GIMP were prepared by grinding in a knife mill (SM2000, Retsch) with a 0.5 mm screen. The hay was sieved after grinding and the fraction of 315-500 microns was used.

Non-tobacco fibers of bamboo and Fibrex were used as is from the provider.

Each type of the different non-tobacco fibers was incorporated into separate samples of 1000 g each of the above-prepared tobacco composition to the content specified in table 3, calculated as the weight of non-tobacco fiber divided with the weight of ground tobacco.

The water content of the final smokeless tobacco composition was adjusted to 49 wt %. The incorporation of the non-tobacco fibers into the semi-finished tobacco composition was made in a kitchen mixer, fabricate "Kenwood Major", all non-tobacco fibers was added at the same time and the mixing started immediately thereafter and continued for 30 seconds. After mixing the final smokeless tobacco composition was transferred to a plastic bag.

The final smokeless tobacco compositions with different content of non-tobacco fibers was each poured up to 100 ml in a 100 ml beaker and the beaker with the final smokeless tobacco composition was weighed, This procedure was performed in three replicates for each composition. The average weight of each composition was calculated. The density results for each composition are specified in table 3, and the specific density change for bamboo BAF 400DV is illustrated in FIG. 3. The gradient for the density change of BAF 400DV in the graph was calculated based on the natural logarithm. The density changes and the natural logarithm were calculated for all final smokeless tobacco compositions. Table 3 specifies the gradient in numbers, furthermore, FIG. 4 illustrate the gradient of the natural logarithm for each non-tobacco fiber type as calculated from the density changes as a function of the fiber content of respective non-tobacco fiber type in the final smokeless tobacco compositions.

All calculations for each composition confirm the packing results for each tobacco composition (table 3). The conclusion is that the non-tobacco fiber average length-to-width ratio is critical for the density change of the snus composition. The results in table 3 show that the average length-to-width ratio may preferably be equal to or greater 3.5:1 in order to obtain desired density change of the smokeless tobacco composition.

TABLE 3

| Composition | | | average length- | Gradient |
|---|---|---|---|---|
| Non-tobacco fiber | Content of non-tobacco fiber (wt %) | Density (kg/dm$^3$) | to-width* ratio of non-tobacco fiber (L/W) | of the natural logarithm |
| Bamboo Fiber BAF 400DV | 0 | 0.52 | 15.3 | −0.112 |
| | 2 | 0.48 | | |
| | 4 | 0.46 | | |
| | 8 | 0.44 | | |
| | 16 | 0.38 | | |
| | 20 | 0.34 | | |

TABLE 3-continued

| Composition | | | average length- | Gradient |
|---|---|---|---|---|
| Non-tobacco fiber | Content of non-tobacco fiber (wt %) | Density (kg/dm$^3$) | to-width* ratio of non-tobacco fiber (L/W) | of the natural logarithm |
| | 24 | 0.31 | | |
| | 32 | 0.29 | | |
| CTMP Fiber 550 | 0 | 0.50 | 11.9 | −0.088 |
| | 2 | 0.47 | | |
| | 4 | 0.47 | | |
| | 8 | 0.44 | | |
| | 32 | 0.31 | | |
| CTMP Fiber 350 | 0 | 0.50 | 10.5 | −0.084 |
| | 2 | 0.48 | | |
| | 4 | 0.47 | | |
| | 8 | 0.44 | | |
| | 32 | 0.32 | | |
| Bamboo Fiber BAF 200 | 0 | 0.50 | 8.6 | −0.048 |
| | 2 | 0.49 | | |
| | 4 | 0.47 | | |
| | 8 | 0.47 | | |
| | 16 | 0.46 | | |
| | 32 | 0.38 | | |
| Hay fraction 315-500 μm | 0 | 0.50 | 6.6 | −0.043 |
| | 2 | 0.47 | | |
| | 4 | 0.48 | | |
| | 8 | 0.45 | | |
| | 16 | 0.44 | | |
| | 32 | 0.41 | | |
| Fibrex 610G | 0 | 0.50 | 3.3 | −0.008 |
| | 2 | 0.49 | | |
| | 4 | 0.49 | | |
| | 8 | 0.49 | | |
| | 16 | 0.49 | | |
| | 32 | 0.48 | | |
| Bamboo Fiber BAF 90 | 0 | 0.50 | 3.3 | 0.006 |
| | 2 | 0.47 | | |
| | 4 | 0.47 | | |
| | 8 | 0.49 | | |
| | 16 | 0.50 | | |
| | 32 | 0.50 | | |
| Bamboo Fiber BAF 40 | 0 | 0.50 | 1.5 | 0.034 |
| | 2 | 0.48 | | |
| | 4 | 0.48 | | |
| | 8 | 0.50 | | |
| | 16 | 0.52 | | |
| | 32 | 0.58 | | |

*length- to-width ratio as used herein denotes the ratio for the length-weighted average fiber length to the average fiber width

Example 4

Smokeless tobacco compositions comprising different amounts of non-tobacco fibers were prepared and the in vivo extraction of nicotine from the different compositions was measured.

A smokeless tobacco composition, R3, was made according to GothiaTek® standard containing the following ingredients:

| Ingredients | (wt %) |
|---|---|
| Water | 56.0 |
| Tobacco mixture (lamina and stem at a ratio of 80:20) | 34.0 |
| Salt | 4.0 |
| Propylene glycol | 3.0 |
| Sodium bicarbonate | 2.7 |
| Flavors | 0.3 |

Three different smokeless compositions were prepared:

A) smokeless tobacco composition R3 without non-tobacco fiber, as a reference, 0.9 g/pouch, B) smokeless tobacco composition R3 with 2 wt % non-tobacco fibers (Bamboo BAF 400), 0.9 g/pouch C) smokeless tobacco composition R3 with 4 wt % non-tobacco fibers (Bamboo BAF 400), 0.7 g/pouch.

Samples were performed in a test-blender (a blender with a max capacity of 40 kg) where the water content was approximately 38% to obtain a half fabricate comprising tobacco material, salt and water. The half fabricate (approximately 40 kg) was then divided in parts of 5 kg batches and mixed with water, flavors, propylene glycol and sodium bicarbonate to the desired final water content of about 56%. Fibers were added at two different concentrations, 2 wt % and 4 wt % respectively. One sample without non-tobacco fibers was used as a reference. The content of non-tobacco fibers is calculated on the total weight of the final tobacco composition.

Pouches were made in the same equipment as used in Example 1 using a portioning wheel for long pouch format (a commercially available pouch format).

Ten consumers of snus consumed four pouches each from each of the three different smokeless tobacco compositions a), b) and c). One pouch at the time was placed in the mouth under the upper lip and above either the left or the right foretooth for 30 minutes.

The nicotine content of the smokeless tobacco composition before use and the nicotine content in pouches of smokeless tobacco was measured after use and compared to the nicotine content in unused pouches. The nicotine content was measured by treating the samples with sodium hydroxide followed by extraction with methyl-tert-butyl ether and then analyzing with a gas chromatograph equipped with a capillary column and a FID-detector. The result is summarized in Table 4.

Smokeless tobacco compositions comprising non-tobacco fibers present a higher grade of nicotine extraction.

TABLE 4

| Product | | | Extracted | Extraction |
|---|---|---|---|---|
| Composition | Weight/ pouch (g/pouch) | Nicotine conc. (mg/pouch) | nicotine (mg/pouch) (Average) | grade nicotine, (%) (Average) |
| A) R3 | 0.9 | 6.89 | 1.74 | 25.2 |
| B) R3 with 2 wt % fiber | 0.9 | 6.75 | 1.81 | 26.8 |
| C) R3 with 4 wt % fiber | 0.7 | 5.17 | 1.43 | 27.6 |

Various embodiments of the present invention have been described above but a person skilled in the art realizes further minor alterations, which would fall into the scope of the present invention. The breadth and scope of the present invention should not be limited by any of the above-described exemplary embodiments, but should be defined only in accordance with the following claims and their equivalents. Other aspects, advantages and modifications within the scope of the invention will be apparent to those skilled in the art to which the invention pertains.

The invention claimed is:

1. An oral smokeless tobacco composition comprising at least one type of non-tobacco fibers, wherein the content of the non-tobacco fibers is from 2 to 32 percent of the dry weight of the final composition, and wherein the non-tobacco fibers have an average length-to-width ratio equal to or greater than 3.5:1 and equal to or lower than 15.3:1, wherein the non-tobacco fibers are selected from the group consisting of oat fibers, hay fibers, chemo-thermo-mechanical pulp fibers, bamboo fibers, and any combinations thereof.

2. The oral smokeless tobacco composition of claim 1, wherein the non-tobacco fibers have an average length-to-width ratio equal to or greater than 6:1.

3. The oral smokeless tobacco composition of claim 1, wherein the non-tobacco fibers have an average length-to-width ratio equal to or greater than 10:1.

4. The oral smokeless tobacco composition of claim 1, wherein the non-tobacco fibers have an average length-to-width ratio equal to or greater than 15:1.

5. The oral smokeless tobacco composition of claim 1, wherein the content of the non-tobacco fibers in the composition is from 2 to 30 wt % based on the dry weight of the final composition.

6. The oral smokeless tobacco composition of claim 1, wherein the at least one type of non-tobacco fibers originates from bamboo.

7. The oral smokeless tobacco composition of claim 1, wherein the non-tobacco fibers is a combination of two or more types of non-tobacco fibers.

8. The oral smokeless tobacco composition of claim 1, wherein the smokeless tobacco is a moist snuff.

9. The oral smokeless tobacco composition of claim 8, wherein the smokeless tobacco is snus.

10. The oral smokeless tobacco composition of claim 1, wherein the composition comprises 10-60 wt % water, based on the total weight of the composition.

11. The oral smokeless tobacco composition of claim 1, wherein the composition is provided in the form of a portion package, or in loose form in a can or a box.

12. The oral smokeless tobacco composition of claim 1, wherein the composition is provided in the form of a portion package.

13. The oral smokeless tobacco composition of claim 12, wherein the portion package is in the form of a pouch.

14. The oral smokeless tobacco composition of claim 12, wherein the portion package is packed in a container or box.

15. A method for manufacturing an oral smokeless tobacco composition according to claim 1, comprising:

providing a tobacco material;

processing the tobacco material;

adding non-tobacco fibers to the tobacco material, wherein the non-tobacco fibers are mixed with the tobacco material into a uniform blend.

16. The method of claim 15, wherein the processing of the tobacco material comprises heat treatment.

17. The method of claim 16, wherein the heat treatment is a pasteurization process.

18. The method of claim 15, wherein the non-tobacco fibers are added prior to the processing of the tobacco material.

19. The method of claim 15, wherein the non-tobacco fibers are added during the processing of the tobacco material.

20. The method of claim 15, wherein the non-tobacco fibers are added after the processing of the tobacco material.

21. The method of claim 15, wherein water and sodium chloride (NaCl) are added prior to the processing of the tobacco material.

22. The method of claim 15, wherein water, flavors, and sodium carbonate are added during the processing of the tobacco material.

23. The oral smokeless tobacco composition of claim 15, wherein the composition is provided in the form of a portion package, or in loose form in a can or box.

* * * * *